United States Patent [19]

Tirrell

[11] Patent Number: 4,833,061

[45] Date of Patent: May 23, 1989

[54] PHOTOSENSITIVE PHOSPHOLIPID VESICLES

[75] Inventor: David A. Tirrell, Sunderland, Mass.

[73] Assignee: Minnesota Mining and Manufacturing Company, St. Paul, Minn.

[21] Appl. No.: 34,855

[22] Filed: Apr. 6, 1987

[51] Int. Cl.[4] ..... G03C 1/06; G03C 1/72; G03C 7/733

[52] U.S. Cl. ..... 430/138; 430/152; 430/176; 430/270; 430/290; 430/338; 430/339; 430/345; 522/31; 522/32; 522/63; 522/65; 522/68; 522/6

[58] Field of Search ..... 430/152, 176, 270, 138, 430/290, 338, 339, 345; 522/6, 13, 14, 15, 16, 31, 32, 63, 65, 68

[56] References Cited

U.S. PATENT DOCUMENTS

| | | | |
|---|---|---|---|
| 4,109,068 | 8/1978 | Allen | 430/270 |
| 4,363,866 | 12/1982 | Rennison et al. | 430/176 |
| 4,483,912 | 11/1984 | Sanders | 430/138 |
| 4,581,313 | 4/1986 | Minauizono et al. | 430/176 |
| 4,636,453 | 1/1987 | Keys et al. | 430/138 |
| 4,675,310 | 6/1987 | Chapman et al. | 514/76 |
| 4,687,725 | 8/1987 | Wright et al. | 430/138 |
| 4,696,863 | 9/1987 | Matsushite et al. | 430/138 |

FOREIGN PATENT DOCUMENTS

| | | | |
|---|---|---|---|
| 1216764 | 3/1986 | U.S.S.R. | 430/152 |

OTHER PUBLICATIONS

Yatuin, M. B., et al., *Science,* vol. 210, 12/1980, pp. 1253–1255.

"pH Sensitization of Phospholipid Vesicles via Complexation with Synthetic Poly(carboxylic acid)s", D. A. Tirrell et al., Annals of the New York Academy of Sciences, pp. 237–248.

Textbook of Biochemistry, 2nd Edition, E. S. West, Ph.D. The Macmillan Company, New York, 1955, pp. 168–177.

*Primary Examiner*—Charles L. Bowers, Jr.

*Attorney, Agent, or Firm*—Donald M. Sell; Walter N. Kirn; Mark A. Litman

[57] ABSTRACT

Photosensitive compositions having surfactant vesicles therein are described. A method is also shown in which the photosensitive vesicle containing an enclosed substance is exposed to light to control the release of the substance.

14 Claims, No Drawings

PHOTOSENSITIVE PHOSPHOLIPID VESICLES

BACKGROUND OF THE INVENTION

1. Field of the Invention

This invention relates to the photoinitiated release of a drug, dye or other material from a surfactant vesicle such as a phospholipid vesicle into a surrounding environment.

More particularly, this invention relates to the photoinitiated solubilit-controlled alteration (e.g., disruption, reorientation or solubilizatin) of a polyelectrolyte surrounding a surfactant vesicle such as a phosphatidylcholine vesicle dispersed in aqueous media. The alteration occurs by means of a polyelectrolyte material which is sensitive to radiation and responsively changes its solubility in the aqueous medium. Such polyelectrolyte materials have a titratable funtional group. A titratable functional group is defined as a group that will accept or release protons such as an acidic titratable functional group or a basic titratable functional group. The titratable material, which may or may not be a polymer, may be dispersed in or soluble in the aqueous medium or it may be anchored on the vesicle wall prior to its vesicle release affecting activity.

2. Background of the Art

Small amounts of materials have previously been provided by means of capsules or microcapsules. Solid, semisolid, oil or liquid materials have been provided in capsule form for such diverse suses as medication, agricultural supplements, imaging, lubrication, fragrances and the like. The capsules or microcapsules have normally been opened by physical forces such as pressure or abrasion as shown in U.S. Pat. Nos. 3,016,308; 3,516,941; 4,201,404; 4,487,801 and 4,606,956. U.S. Pat. No. 3,503,783 discloses microcapsules having coloring material therein which capsules are rupturable by the application of heat, pressure and/or radiation because of a metal coating on the surface of a capsule.

SUMMARY OF THE INVENTION

The present invention relates to radiation sensitive vesicles of surfactants including phospholipids. Vesicles are first formed of surfactants such as phospholipids. The vesicles contain a substance entrapped during production of the vesicles which substance is controllably released from the vesicle and prevented from release or reduced in its rate of release by radiation induced alteration of the confining properties of the phospholipid shell of the vesicle. The surface of the vesicles is contacted with a non-solubilizing, photosensitive, pH alterable polyelectrolyte. Upon photoinitiated alteration of the ionization of the polyelectrolyte, the coherence of the phospholipid is altered so that is may more strongly retain the material within the vesicle walls.

DETAILED DESCRIPTION OF THE INVENTION

Functional materials, either in the form of solids, semisolids or liquids, are enclosed within surfactant vesicles such as phospholipid vesicles. The vesicles are associated with a photosensitive polyelectrolyte, the ionization of which is altered upon stimulation by actinic radiation. The change in the ionization of the polyelectrolyte or the environment around the polyelectrolyte alters the association of the phospholipids in the vesicle walls. This alteration in the association enables the functional materials to be less readily released to the environment outside of the vesicles.

Surfactant vesicles are by themselves well known in the art. These are vesicles made from surfactants that have a bilayer vesicle structure in water. An excellent background review of surfactant vesicles is provided in *Membrane Mimetic Chemistry,* J. H. Fendler, Wiley Interscience, 1982, N.Y., especially Chapter VI. An extensive table of useful surfactants for forming vesicles is provided on pages 160–168 and is hereby incorporated by reference. Typical surfactants used in making surfactant vesicles are long chain ammonium salts. That is, many of the surfactants are ammonium salts having four alkyl substituents, the total carbon content of all of the alkyl groups generally being at least 32 carbon atoms. Phospholipid vesicles are also included within the term surfactant vesicles.

The phospholipids, phosphatides as they are alternatively names, are lipids which contain phosphorous. The phosphorous is present in the material as esterified phosphoric acid. There are three general classes of phospholipids, the lecithins, cephalins, and sphingomyelins. Lecithins are composed of glycerol, fatty acids, phosphoric acid, and the quaternary base, choline. Cephalins are similar to lecithins except that choline is replaced by cholamine or serine as constituent. Sphingomyelins are composed of fatty acids, phosphoric acid, choline and a complex amino acid, sphingosine. There is no glycerol. present, and it is probable that the choline could also here be replaced by other amines. The lecithins and sphingomyelins are generally preferred, and the lecithins are most preferred in the practice of the present invention. Typical compounds within these classes are alpha-phosphatidyl choline (alpha-lecithin), beta-phosphatidyl choline (beta-lecithin), alpha-phosphatidyl chlomaine, beta-phosphatidyl cholamine, alpha-phosphatidyl ethanolamine, alpha-phosphatidyl-beta-stearate-sphingosine, beta-phosphatidylalpha-oleate-sphingosine, and the like. These compounds are well described in the literature such as *Textbook of Biochemistry,* 2nd Ed., E. S. West and W. R. Rodd, 1955, MacMillan Co., N.Y., pp 168–179.

These phospholipids are associated with pH-sensitive water-soluble materials having titratable functional groups and pH-altering photosensitive groups or are associated indirectly with materials that are not water soluble but which may serve to anchor pH-sensitive compounds on the vesicle membrane prior to their vesicle altering activity, including cholesterol, long chain fatty acids and long chain amines.

Photosensitive polyelectrolytes according to the practice of the present invention are polymeric chains bearing titratable functional groups that can be converted from a charged to an uncharged form, or from an uncharged form to a charged form by the binding or release of protons, these polymer chains also bearing photosensitive groups that undergo structural changes upon absorption of light. Examples of titratable groups are carboxylic acids, phosphoric acids, phosphonic acids, phosphinic acids, sulfonic acids, sulfuric acids, alcohols, amines, thiols, imides, and the like. In addition to the acids, per se, esters and salts of the acids are contemplated in the practice of the present invention (e.g., carboxylic acid esters, sulfonates, etc.). Any of the many different classes of photosensitive groups may be used in the practice of the present invention such as, for example, azobenzenes, spirobenzopyranes, sulfonium ions, iodonium ions, diazonium ions, amine oxides, and the like.

An example of a pH-sensitive water soluble material having proton titratable functional groups is poly(α-ethylacrylic acid), which can be used in dilute aqueous solution. Examples of pH-sensitive water soluble material shaving basic titratable groups are hydrophobic water soluble polyamines. Examples of materials which are not water soluble but which may serve to anchor pH-sensitive compounds on the vesicle membrane prior to their vesicle altering activity include cholesterol, long chain fatty acids and long chain amines.

The above vesicle altering materials all have a titratable functional group. The water solubility of the materials or the vesicle anchoring ability is pH-dependent, which enables the vesicles to achieve controlled release of vesicle contents in respone to a change in environmental pH. Acidic functional groups will disrupt the wall of or solubilize phosphatidylcholine vesicles upon a drop in pH and basic functional groups will disrupt the wall of or solubilize phosphatidylchline vesicles upon an increase in pH.

The pH-sensitive molecules will react to a change in pH incurred by activation of the pH altering photosensitive group.

This invention can achieve photoinitiated, controlled release of a drug, dye or other material from a phospholipid vesicle. The vesicle can comprise a fatty phospholipid, e.g., egg yolk phosphatidylcholine. The photostimulable, pH-sensitive material can be outside the vesicle or inside the vesicle, or both. The interior of the vesicle contains a functional material such as a drug or dye or other material to be released upon disruption of the vesicle with a photoinitiated change in ionization. If an acidic water soluble material is employed, the vesicles can be dispersed in an aqueous medium having a pH above about 7, i.e, about 7.4–9.0. If a basic water soluble material is employed, the vesicles can be dispersed in an aqueous medium having a pH below about 7, i.e., about 5.

As stated above, the material having a titratable functional group may be dissolved in the aqueous medium surrounding the vesicle and may also be contained in an aqueous medium in the interior of the vesicle. If desired, the material may be contained in the aqueous medium in the interior of the vesicle without being present in the medium surrounding the vesicle. The reason is that the pH in the medium surrounding the vesicle tends to permeate to the interior of the vesicle. For example, the vesicle wall is permeable to protons. If a water soluble acidic polymer is employed as the material, upon a drop in pH in the aqueous environments the polymer becomes less soluble in the aqeous medium, is adsorbed on the vesicle, and disrupts the phospholipid vesicles, allowing the drug or dye to escape. Adsorption of the polymer by the phospholipid occurs without chemical reaction of the polymer with the phospholipid. If a water soluble basic material is employed, upon an increase in pH the material becomes less soluble, is adsorbed on the phospholipid and similarly disrupts the phospholipid vesicles. If the pH sensitive material is initially anchored onto the vesicle membrane, upon a change in pH in an indicated direction, the vesicle wall is disrupted. If the pH is changed significantly, the material having a titratable group may also be changed so that it does not remain the same material (e.g., goes from a salt to an acid with lowering of the pH).

Each phospholipid molecule can comprise a polar group on one end and two fatty $C_{16-24}$ hydrocarbon chains on the other end. The phospholipid moledcules form a two molecule thick bilayer vesicle wall or membrane with the interiorally adjacent to each otehr so that the polar groups are remote from each other and form the outer and inner surfaces of the vesicle wall. Since the polar groups are hydrophilic this is the natural arrangement where the vesicle is surrounded by and encloses an aqueous medium.

The end-to-end phospholipid material pairs tend to arrange themselves side-by-side in a tightly packed and well ordered arrangement. This ordered arrangement tends to resist disruption by the pH sensitive molecule upon a change in pH. Therefore, it often has been found to be desirable, but not essential to the invention that the phospholipid be used at a temperature at least equal to its melting point to impart disorder to the bilayer assembly of phospholipid molecules. The disorder imparted at the temperature of use provides room between adjacent phospholipid molecules so that upon a change in pH, the photostimulated pH-sensitive material, which loses some of its water solubility due to the change in pH can be adsorbed betwen the phospholipid molecules and thereby cause disruption of the phospholipid vesicle.

Egg yolk phophatidylcholine is a preferred phosphatidylcholine of this invention because it has a subambient order-disorder transition or melting temperature ($T_m = -15°$ C.). Dipalmitoylphosphatidylcholine has the disadvantage of a high melting point (41° C.). Although dilauroylphosphatidylcholine is disordered at room temperature, it possesses the disadvantage that it is not a good container for dyes. Obviously, the phosphatidylcholine employed must be an effective container for the material whose release is pH-dependent.

There are many potential applications of this invention. Non-limiting exmaples includes: (1) delayed or site-specific release of topically applied drugs; (2) detection of tampering in packages during storage where the tampering causes exposure to light and the like. Other potential applications of this invention include pharmaceutics, imaging, instrument sensing and medical diagnostics.

The literature has reported an attempt, but without success, to obtain controlled release of a dye from phophatidylcholine vesicles. K. Seki and D. A. Tirrell, Polym. Prepr, Am. Chem. Soc. Div. Polym. Chem., 24 (2), 26 (1983) report a test to measure the rate of effflux of a fluorescent dye, 6-carboxylfluorescein, from an aqueous suspension of unilamellar vesicles of dipalmitoylphosphatidyloline (DPPC) (M.P. 41° C.). The test was performed at ambient temperature without any preheat. Poly(α-ethylacrylic acid) was added to the vesicle suspension at a pH of 7.4 and at room temperature. No rapid release of the dye was detected. While the polymer did modify the state of organization of the lipid bilayer, the barrier properties of the bilayer were largely preserved. This article did not meet the conditions of the present invention at least because the pH was not lowered sufficiently, i.e., below 7.

Subsequent to that article, a successful attempt to produce pH-controlled release from phosphatidylcholine vesicles has been reported (D. A. Tirrell, D. Y. Takigawa, and K. Seki, Ann. N.Y. Acad, Sci. 446, 237 (1985). In this article, it is the vesicles which are pH sensitive in dilute solutions of poly(alpha-ethylacrylic acid).

In the present invention, the polyelectrolyte is associated with the vesicle ether by suspending the vesicles in a polyelectrolyte solution or by linking a polyelectrolyte to the vesicle surface by a chemical reaction. The most successful method to date involves the linking of a polyelectrolyte bearing thiol groups to a vesicle bearing maleimido functions. These and otehr aspects of the invention will be shown in the following non-limiting examples.

EXAMPLE 1

Preparation of N-[4-(Phenylazo)phenyl]methacrylamide

N-[4-(Phenylazo)phenyl]methacrylamide (PAPM) was prepared by reacting 0.02 mol alpha-phenylazoaniline with 0.02 mol of metacryloyl chloride in $CHCl_3$ in the presence of 0.02 mol triethylamine. After two hours at room temperature the solution was filtered and the $CHCl_3$ removed to yield an oragne solid (88% theoretical) which was recrystallized from ethanol and water.

Preparation of Photosensitive Electrolyte

A 3/1 molar mixture of 3 parts methacrylic acid (MAA) and 1 part PAPM were copolymerized by free radial initiation. This afforded a 3/1 MAA/PAPM photosensitive electrolyte copolymer.

The polyermization was carried out in 7.4 M solution of the monomers in acetone/water (4/1) in a vacuum-sealed ampoule. The polymerization was initiated using a 2 mol % azobisisobutyronile (AIBN) at a temperature of 65°-68° C. The polymer was precipitated into ethyl acetate and reprecipitated at least twice using the same solventprecipitant combination. Copolymer composition was determined by careful itegration of the aromatic and aliphatic portions of the 300 MHz 'H NMR spectrum. The inherent viscosity of the copolymer (0.2% in 50 mM phosphate, pH 7.4, 30° C.) was 1.48 dL/g.

Differential Scanning Calorimetry

Differential scanning calorimetry samples were prepared by adding 2.0 mg of DPPC to 2.0 ml of a 1.0 mg/ml solution of the polymer in 50 mM phosphate buffer, pH 6.7. This solution was heated to ca. 45° C. for 1 minute and vortexed for 1 minute. The heating and vortexing were carried out three times, and the sample was degassed under vacuum. The degassed sample (0.9 m.) was introduced into the DSC sample chamber; the same volume of buffer was used in the reference chamber. Calorimetric scans were recorded on a Microcal MC-1 instrument at a heating rate of 15° C./hr.

Permeation Rates

Samples for determination of dye release rates were prepared by adding 15 mg of DPPC to 20 ml of a 200 mM calcein solution in 50 mM sodium phosphate buffer, pH 6.7. The sample was heated to 50° C. for 1 minute and then vortexed for 1 minute; this cycle was repeated three times. The sample was sonicated for 30 minutes at 20 watts and then centrifuged at high speed in a table-top centrifuge for 30 minutes. The top 1.5 ml fo the centrifuged sample was placed on a Sephadex G50-300 column (1.6×10 cm) and eluted with phosphate buffer at pH=6.75. The unilamellar vesicles with entrapped calcein eluted in the void volume. Unilamellas vesicles (1.0 ml) were added to 1.0 ml of a 2.0 mg/ml polymer solution in phosphate buffer. The fluorescence of the samples at 530 nm was monitored as a function of time suing an excitation wavelength of 495 nm.

Irradiation

Irradiation samples were irradiated in Pyrex test tubes in a Tayonet RMR 400 minireactor equipped with four 350 nm lamps and a merry-go-round apparatus. The concentration of the samples was 0.1 mg/ml. The samples irradiated with the $N_2$ laser were held in a 0.1 cm quartz cell used for UV measurements. The samples were held 30 cm from the laser at the focal point of a convex lens used to focus the laser beam. The concentration of the samples irradiated with the laser was 0.1 mg/ml.

What is claimed is:

1. A photosensitive composition comprising a phospholipid surfactant vesicle containing a substance different from the composition of the vesicle and in association with the exterior of the vesicle a pH-sensitive, photosensitive polyelectrolyte, wherein upon photoinitiated alteration of the ionization of the polyelectrolyte, the coherence of the phospholipid is altered so it may more strongly retain the substance within the walls of the vesicle.

2. The composition of claim 1 wherein said surfactant vesicle comprises a long chain alkyl ammonium salt.

3. The composition of claim 1 wherein said surfactant vesicle comprises a phospholipid.

4. The composition of claim 1 wherein said polyelectrolyte comprises a polymer having titratable groups and photosensitive groups that undergo structural changes upon absorption of light.

5. The composition of claim 2 wherein said polyelectrolyte comprises a polymer having titratable groups and photosensitive groups that undergo structural changes upon absorption of light.

6. The composition of claim 3 wherein said polyelectrolyte comprises a polymer having titratable groups and photosensitive groups that undergo structural changes upon absorption of light.

7. The composition of claim 4 wherien said titratable groups are selected from the class consisting of carboxylic acids, phosphoric acid, phosphonic acid, phosphinic acid, sulfonic acid, sulfuric acid alcohols, amines, thiols and imides.

8. The composition of claim 5 wherein said titratable groups are selected from the class consisting of carboxylic acids, phosphroic acid, phosphonic acid, phosphinic acid, sulfonic acid, sulfuric acid, alcohols, amines, thiols and imides.

9. The composition of claim 6 wherein said titratable groups are selected from the class consisting of carboxylic acids, phosphoric acid, phosphonic acid, phosphinic acid, sulfonic acid, sulfuric acid, alcohols, amines, thiols and imides.

10. The composition of claim 1 wherein said photosensitive polyelectrolyte has a photosensitive moiety attached thereto, said moiety selected from the gruop consisting of azobenzenes, spirobenzopyrons, sulfonium ions, iodonium ions, diazonium ions, and amine oxides.

11. The composition of claim 4 wherein said photosensitive polyelectrolyte has a photosensitive moiety attached thereto, said moiety selected from the group consisting of azobenzenes, spirobenzopyrons, sulfonium ions, iodonium ions, diazonium ions, and amine oxides.

12. The composition of claim 5 wherein said photosensitive polyelectrolyte has a photosensitive moiety attached thereto, said moiety selected from the group consisting of azobenzenes, spirobenzopyrans, sulfonium ions, iodonium ions, diazonium ions, and amine oxides.

13. The composition of claim 6 wherein said photosensitive polyelectrolyte has a photosensitive moiety attached thereto, said moiety selected from the group consisting of azobenzenes, spirobenzopyrans, sulfonium ions, iodonium ions, diazonium ions, and amine oxides.

14. The composition of claim 7 wherein said photosensitive polyelectrolyte has a photosensitive moiety attached thereto, said moiety selected from the group consisting of azobenzenes, spirobenzopyrans, sulfonium ions, iodonium ions, diazonium ions, and amine oxides.

* * * * *